United States Patent [19]

Ferrer

[11] Patent Number: 4,712,365

[45] Date of Patent: Dec. 15, 1987

[54] PROCESS FOR THE MANUFACTURE OF REINFORCED FALSE TWIST YARNS

[76] Inventor: Fernando F. Ferrer, Anselmo Clavé, 6 Calella (Barcelona), Spain

[21] Appl. No.: 914,518

[22] Filed: Oct. 2, 1986

Related U.S. Application Data

[63] Continuation of Ser. No. 759,149, Jul. 26, 1985, abandoned.

[30] Foreign Application Priority Data

Jul. 27, 1984 [ES] Spain ..... 534.967

[51] Int. Cl.[4] ..... D01H 5/28; D02G 3/26; D02G 3/36

[52] U.S. Cl. ..... 57/12; 57/6; 57/293; 57/328; 57/331

[58] Field of Search ..... 57/6, 12, 293, 294, 57/328, 331

[56] References Cited

U.S. PATENT DOCUMENTS

| | | | |
|---|---|---|---|
| 2,552,210 | 5/1951 | Parker | 57/328 |
| 3,225,533 | 12/1965 | Henshaw | 57/331 X |
| 3,443,370 | 5/1969 | Walls | 57/293 |
| 4,069,656 | 1/1978 | Arai et al. | 57/293 X |

*Primary Examiner*—John Petrakes
*Attorney, Agent, or Firm*—Holman & Stern

[57] ABSTRACT

A process for manufacturing reinforced false twist yarns includes employing braking rolls, drawing bands, pulling rollers, twisting rolls, and yarn guides to manufacture a reinforced false twist yarn from first and second fiber rovings and from a continuous fiber yarn. The yarn guides are separated from one another such that, when the first roving is combined with the second roving and continuous fiber yarn, untwisted regions of the first fiber roving are in substantially non-overlapping relationship with untwisted regions of the second fiber roving.

3 Claims, 3 Drawing Figures

PROCESS FOR THE MANUFACTURE OF REINFORCED FALSE TWIST YARNS

This is a continuation of application Ser. No. 759,149, filed July 26, 1985 and now abandoned.

BACKGROUND OF THE INVENTION

As it is known, at the present time one of the major existing problems in the manufacture of acrylic yarns of the so-called false twist type is their low strength, and they have consequently been going out of use.

These acrylic false twist yarns are manufactured from a roving of evidently acrylic material which, after undergoing a certain drawing, passes through two rolls which, in addition to being endowed with the necessary rotation to make the yarn come out, gives them a traversing transverse movement with respect to the direction of movement of the yarn, thereby causing it to twist.

Evidently, each time these rolls change their direction of movement, and due to the fact that the rotation of the rolls cannot be braked, in one segment of the yarn which is being produced there will be no twist at all.

Logically, such twisting will be produced in two different directions according to the direction of movement of the rolls and, therefore, in those areas the strength of the yarn, by not having any twist at all, is extremely low, to the detriment of its quality.

In order to obtain acrylic yarns with two ends, the same process which has just been described and discussed continues to be used, with the particularity that once the yarn has been obtained, after its respective drawing in two collateral rovings, one of the yarns is taken to that which emerges in its adjacent position, thus achieving a lag between each of the areas of the respective yarns in which no twist has been produced, and the area of the yarn which has no twist thus becomes slightly overlapped with the area of the other yarn which wraps it with its own twist. Even so it is not possible to completely eliminate areas of the yarn in which there is no twist, and the same problem thus subsists of achieving good strength in this type of yarn.

SUMMARY OF THE INVENTION

For the purpose of correcting all these drawbacks, a process has been devised by which an acrylic yarn of two ends may be obtained which will be reinforced by another yarn of continuous fiber, such as polyester, polyamide, etc.

The process of the present invention will consist of having the rovings of acrylic fiber be appropriately drawn due to the existence of two sets of different rolls which will turn at different speeds, so that the roll situated in the position nearest the input of the respective rovings will have a lower speed than the output roll, which will be the puller.

Between these two sets of rolls there are a pair of bands which will guide and, in turn, draw the roving to obtain in this way the respective yarn.

A yarn of continuous fiber, such as polyester, is situated in a position parallel to one of these two rovings, and this yarn will be inserted between the bands which lead to the respective rovings, whereby the continuous fiber yarn does not undergo excessive enlongation which would be produced if it were to be inserted like the roving through the braking rolls since it would then break.

As may be understood, this continuous fiber yarn will continue in its movement together with that of the roving, in which it has been placed adjacently and thereby, when the yarn obtained by the drawing of the acrylic fiber roving reaches the twisting rolls, and since the continous fiber yarn is situated collaterally, both yarns will be twisted jointly, thus forming a yarn of two ends, one of which is acrylic and the other of continuous fiber.

The collaterally situated roving will also have been converted into a yarn which, simultaneously with that formed by the acrylic fiber yarn and the continuous fiber yarn, will have undergone its respective twisting. At this moment, the yarn formed by the continuous fiber and the acrylic fiber will be taken to where it twists by its own inertia around the acrylic fiber yarn, thus achieving, due to this little movement, a substantial reduction in the area of the yarn in which there is no twist at all, and said area is reinforced by the action of the continuous fiber yarn which is indeed twisted.

This type of yarn is basically used for the manufacture of knit fabric, which implies that, given the low strength of the traditionally existing false twist yarns, it is necessary that the fabric obtained with them be reinforced by adding another continuous fabric yarn in order to obtain the desired strength.

Evidently, this poses a large number of drawbacks since, in the first place, the acrylic fabric yarn and the continuous fabric yarn, in the case in which they do not have identical color features, which is extremely difficult to achieve, will produce "streaking" upon being woven, making it necessary to discard the garments obtained with them.

Moreover, it should also be taken into consideration that the use in looms of a bobbin of acrylic yarn and another bobbin of continuous fiber makes it necessary to graduate the tension of both bobbins in order to achieve a perfect adjustment between them while moreover, for this reason, the possibilities of breakage of the yarn are multiplied as a result of the existence of two different bobbins, since the existence of the continuous fiber bobbin is indispensable in order to obtain and achieve the desired strength.

Another aspect of importance is that, since the acrylic fiber yarns have a relatively low strength, they deteriorate relatively easily while the continuous fiber yarn remains in perfect condition.

All this stresses the importance of obtaining, with the process of the present invention, a yarn which is of acrylic fiber and reinforced with another yarn of continuous fiber, since in such case the looms will not require the addition of a continuous fiber yarn and all that will be necessary is the use of a single bobbin, with the aforementioned having a favorable effect since, because this is acrylic yarn reinforced with another yarn of continuous fiber according to the inventive process, breakage of the yarn will be practically eliminated.

BRIEF DESCRIPTION OF THE DRAWINGS

FIG. 1 illustrates a side view of the apparatus discussed hereunder.

FIGS. 1 and 2 show that in order to obtain the reinforced false twist yarn, the process begins with two conventional rovings of acrylic fiber (10) and (11), which will be taken to the braking rolls (12) and (13) through a guide roller (240), which is endowed with separate notches (not shown) to house the respective rovings.

Figure 1:
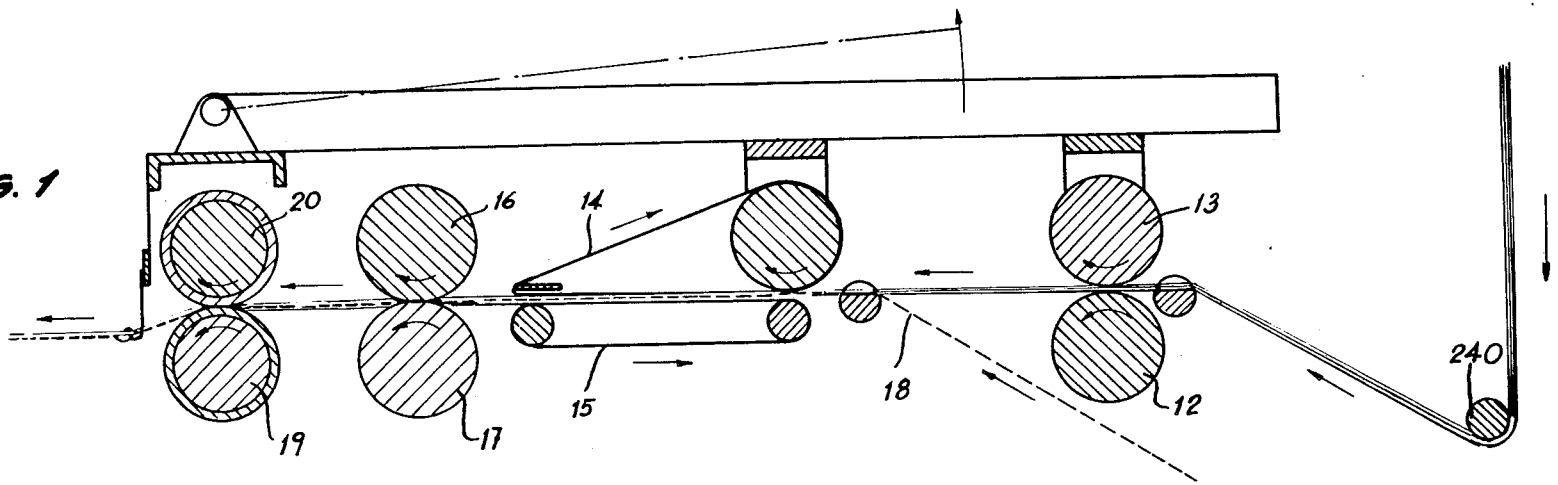
FIG. 1 is a schematic view in elevation which shows the manufacture of the yarn according to the proposed process.

This roving, in turn, is taken through the drawing bands (14) and (15) to the pulling rolls (16) and (17).

Figure 2:
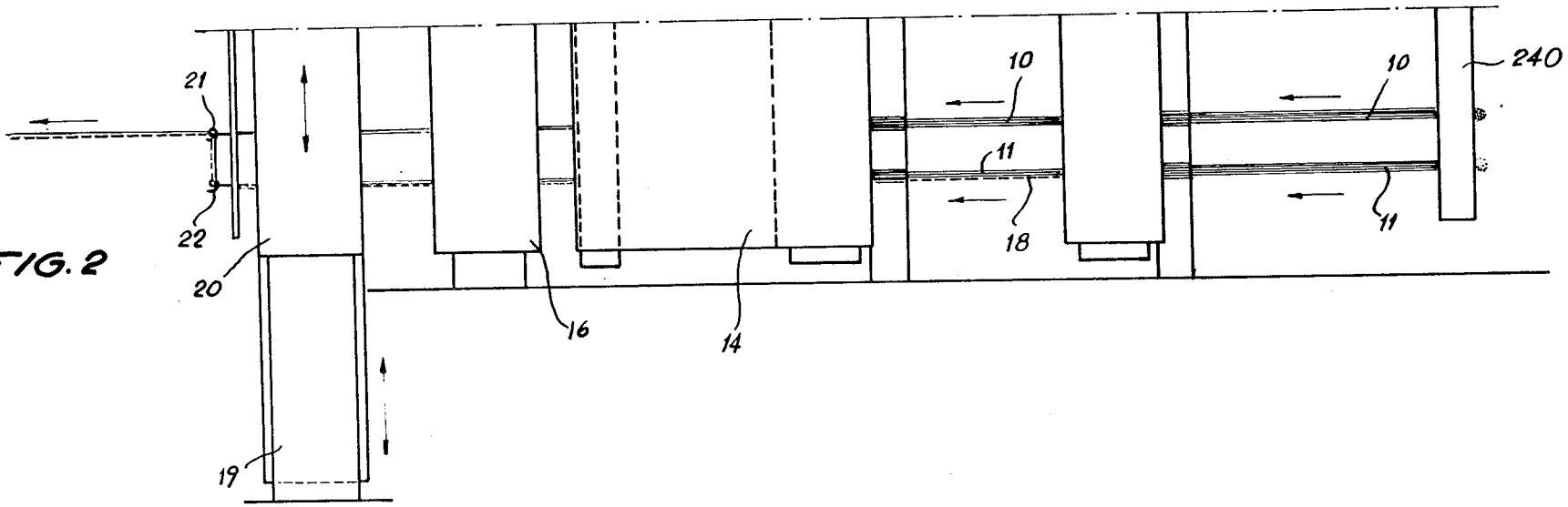
FIG. 2 is a plan view of FIG. 1.

Collaterally with respect to the roving (11) a continuous fiber yarn (18) shall be situated so that this yarn is located beside the aforementioned roving (11) in the area which is situated on the drawing band (14) (15) as seen as a dotted line in FIG. 2.

The rovings (10) and (11) undergo drawing because the turning speed of the pulling rolls (16) and (17) is greater than the turning speed of the braking rolls (12) and (13), with the speeds of the bands (14) and (15) being related to achieve the drawing of the rovings in a gradual and constant way.

As seen, the continuous fiber yarn (18) will undergo substantially lesser drawing than the roving (11), because it is inserted precisely at the start of the bands (14) and (15), and thus, when that yarn (18) emerges together with that formed by the drawing of the roving (11) due to the action of the pulling rolls (16) and (17), it will be taken to the twisting rolls (19) and (20), which are endowed with a turning movement with respect to their respective axes and, at the same time movement will be imparted to it in the longitudinal direction with respect to each respective axis, with twisting roll (20) moving in the direction opposite the movement of roll (19), as indicated by the double-headed arrows in FIG. 2.

In this way, it is evident that it is precisely with this longitudinal movement (indicated by the double-headed arrows) with respect to the axes of the rolls 19, 20 that the twisting will be produced in the yarns obtained by drawing the rovings (10) and (11), causing them, because of the existence of the yarn formed by the roving (11) and the yarn (18), to twist around each other and thus form a yarn of two ends, that is, the yarn formed by the drawing of the roving (10) emerges, since the roving, upon passing through rolls (19) and (20) will have been previously twisted, and thanks precisely to the distance between guides (22) and (21), the untwisted area of the yarn formed by the drawing of the roving (10) is partially wrapped by the yarn formed by the drawing of the roving (11) and that of the continuous fiber (18), with these two yarns twisting themselves around roving (10) by their own resilient tendency, thus obtaining a yarn of three ends formed by two acrylic fiber ends and one continuous fiber end.

Figure 3:
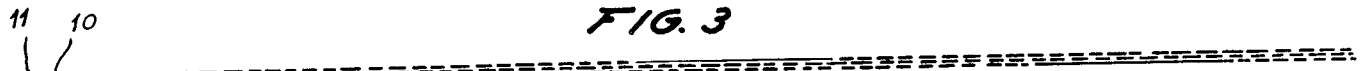
FIG. 3 is a schematic detail of the yarn which is composed.

FIG. 3 does not correspond directly to the location of the yarn shown below it in FIG. 2, but rather shows a schematic detail of how the yarn obtained by this procedure turns out. In this figure, a zone (23) may be observed which would be formed by the twisting of the yarn formed by the drawing of the rovings (10) (11) and the yarn (18).

In zone (24) the yarns (11) and (18) would be twisted together whereas yarn (10) would not be twisted.

In zone (25) the three ends would be twisted again, and the twisting cycle of the yarn would continue in this way.

As may be seen in FIG. 3, zone (24) will always represent the most unfavorable location of the resulting yarn that will be formed by the twisting of an acrylic fiber roving and the continuous fiber yarn, thus obtaining substantial strength.

A detailed description having been made of the present invention in accordance with the attached drawings, it will be understood that any changes are contemplated as being within the scope of the present invention in the following claims.

I claim:

1. A process for manufacturing reinforced false twist yarns, comprising:

supplying a first and a second fiber roving;

supplying a continuous fiber yarn;

providing a pair of braking rolls to cause drag on said first and said second roving;

passing said first and said second roving between said pair of braking rolls;

providing a pair of drawing bands; passing said first and said second roving between said pair of drawing bands, and introducing said continuous fiber yarn between said pair of drawing bands;

providing a pair of pulling rollers to pull said first and said second roving and said continuous fiber yarn; passing said first and said second roving and said continuous fiber yarn between said pair of pulling rollers to cause drawing of said first and said second roving;

providing a pair of twisting rollers to cause twisting of said first and second rovings;

whereby said continuous fiber yarn undergoes substantially less drawing than said first and said second roving due to the effect of said pair of braking rolls on said first and said second roving.

2. A process as claimed in claim 1, further comprising: providing a means for linearly moving said pair of twisting rolls in reciprocating movement relative to one another in a direction generally parallel to an axis of rotation of one of said pair of twisting rolls;

passing said first and said second roving and said continuous fiber yarn between said pair of twisting rolls; linear relative movement of said pair of twisting rolls causes twisting of said first and said second roving and said continuous fiber yarn; said second roving being twisted about said continuous fiber yarn as said second roving and said continuous fiber yarn pass between said pair of twisting rolls.

3. A process as claimed in claim 2, further comprising: providing a first yarn guide and a second yarn guide, said second yarn guide guiding said second roving and said continuous fiber yarn from said pair of twisting rolls to said first yarn guide; said first yarn guide guiding said first roving from said pair of twisting rolls and combining said first roving with said second roving and said continuous fiber yarn;

said first yarn guide being spaced apart a predetermined distance from said second yarn guide; said first roving and said second roving each having untwisted regions due to said reciprocating movement of said pair of twisting rolls;

whereby, due to said predetermined distance between said first yarn guide and said second yarn guide, respective said untwisted regions of said first and second rovings being in substantially non-overlapping relationship when said first roving is wrapped by said second roving and said continuous fiber yarn to produce a reinforced false twist yarn.

* * * * *